US009542805B2

(12) United States Patent
Lerias, III et al.

(10) Patent No.: US 9,542,805 B2
(45) Date of Patent: Jan. 10, 2017

(54) WAGERING GAME WITH IMAGES HAVING DYNAMICALLY CHANGING SHAPES

(71) Applicant: WMS Gaming Inc., Waukegan, IL (US)

(72) Inventors: Victor Vasquez Lerias, III, Morton Grove, IL (US); Jamie W. Vann, Chicago, IL (US); Robby M. Friedman, Round Lake, IL (US); Jason M. Hoffman, Chicago, IL (US); Michael J. Irby, Chicago, IL (US); Robert W. Morgan, Villa Park, IL (US); Kazuki Murakami, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 442 days.

(21) Appl. No.: 13/793,195

(22) Filed: Mar. 11, 2013

(65) Prior Publication Data

US 2014/0004924 A1 Jan. 2, 2014

Related U.S. Application Data

(60) Provisional application No. 61/666,653, filed on Jun. 29, 2012.

(51) Int. Cl.
*A63F 9/24* (2006.01)
*G07F 17/32* (2006.01)

(52) U.S. Cl.
CPC ..... *G07F 17/326* (2013.01); *G07F 17/3211* (2013.01); *G07F 17/3288* (2013.01)

(58) Field of Classification Search
CPC ... G07F 17/00; G07F 17/3211; G07F 17/3213
USPC ..... 463/16, 25, 42
See application file for complete search history.

(56) References Cited

U.S. PATENT DOCUMENTS

| | | | |
|---|---|---|---|
| 6,517,433 | B2 | 2/2003 | Loose et al. |
| 6,666,766 | B2 | 12/2003 | Baerlocher et al. |
| 6,866,585 | B2 | 3/2005 | Muir |
| 6,887,157 | B2 | 5/2005 | LeMay et al. |
| 7,128,647 | B2 | 10/2006 | Muir |

(Continued)

OTHER PUBLICATIONS http://www.havoksimulation.com, Havok Physics: Battle-Tested Physics for Simulation Environments printed from http://www.havoksimulation.com on Jun. 21, 2012, 1 page.

*Primary Examiner* — Jason Skaarup
*Assistant Examiner* — Ryan Hsu
(74) *Attorney, Agent, or Firm* — Nixon Peabody LLP

(57) ABSTRACT

A gaming system for conducting a wagering game displays images having dynamically changing shapes. In one embodiment, a display device displays a screen for a wagering game. The screen presents a first image that follows a first spline. The first spline is defined by one or more curves passing through a first set of control points. A processor determines a second set of control points to define a second spline for the first image. The screen displays the first image transitioning from following the first spline to following the second spline. The screen may present a graphical interaction involving the first image, and the processor is configured to determine the second set of control points in response to the graphical interaction. The graphical interaction may occur between the first image and a second image. Alternatively, an input from a player causes the graphical interaction with the first image.

22 Claims, 12 Drawing Sheets

(56) References Cited

U.S. PATENT DOCUMENTS

| | | | | |
|---|---|---|---|---|
| 7,169,044 | B2 | 1/2007 | Baerlocher et al. | |
| 7,341,511 | B2 | 3/2008 | Fiden et al. | |
| 7,341,520 | B2 | 3/2008 | Mattice et al. | |
| 7,360,761 | B2 | 4/2008 | Durham et al. | |
| 7,367,885 | B2 | 5/2008 | Escalera et al. | |
| 7,465,230 | B2 | 12/2008 | LeMay et al. | |
| 7,572,186 | B2 | 8/2009 | LeMay et al. | |
| 7,862,419 | B2 | 1/2011 | Baerlocher et al. | |
| 7,874,900 | B2 | 1/2011 | Ward et al. | |
| 7,901,289 | B2 | 3/2011 | Schlottmann et al. | |
| 7,909,696 | B2 | 3/2011 | Beaulieu et al. | |
| 7,918,730 | B2 | 4/2011 | Brosnan et al. | |
| 7,934,994 | B2 | 5/2011 | LeMay et al. | |
| 8,002,623 | B2 | 8/2011 | Resnick et al. | |
| 8,012,019 | B2 | 9/2011 | Escalera et al. | |
| 8,029,350 | B2 | 10/2011 | Pacey | |
| 8,038,525 | B2 | 10/2011 | Durham et al. | |
| 8,118,674 | B2 | 2/2012 | Burak et al. | |
| 8,133,111 | B2 | 3/2012 | Thomas | |
| 8,182,339 | B2 | 5/2012 | Anderson et al. | |
| 8,257,175 | B2 | 9/2012 | Mattice et al. | |
| 8,267,767 | B2 | 9/2012 | Kryuchkov et al. | |
| 8,357,040 | B2 | 1/2013 | Ansari et al. | |
| 8,384,710 | B2 | 2/2013 | Schlottmann et al. | |
| 8,414,380 | B2 | 4/2013 | Saunders et al. | |
| 8,454,428 | B2 | 6/2013 | Pacey et al. | |
| 8,500,535 | B2 | 8/2013 | Brosnan et al. | |
| 8,512,139 | B2 | 8/2013 | Williams et al. | |
| 8,523,671 | B2 | 9/2013 | Brosnan et al. | |
| 8,523,672 | B2 | 9/2013 | Kryuchkov et al. | |
| 8,784,206 | B1 * | 7/2014 | Gronkowski et al. | 463/32 |
| 2004/0002380 | A1 * | 1/2004 | Brosnan et al. | 463/32 |
| 2004/0043812 | A1 * | 3/2004 | Ellis | 463/20 |
| 2005/0272492 | A1 * | 12/2005 | Stelly, III | A63F 13/10 463/1 |
| 2006/0058100 | A1 * | 3/2006 | Pacey | G07F 17/3211 463/31 |
| 2008/0113775 | A1 | 5/2008 | Williams et al. | |
| 2008/0125219 | A1 | 5/2008 | Williams et al. | |
| 2009/0061983 | A1 | 3/2009 | Kaufman | |
| 2009/0247254 | A1 | 10/2009 | Schlottmann et al. | |
| 2009/0291731 | A1 | 11/2009 | Jaffe et al. | |
| 2010/0029377 | A1 * | 2/2010 | Canterbury | G07F 17/32 463/25 |
| 2010/0069160 | A1 | 3/2010 | Barrett et al. | |
| 2010/0234094 | A1 | 9/2010 | Gagner et al. | |
| 2010/0234099 | A1 | 9/2010 | Rasmussen et al. | |
| 2011/0045891 | A1 | 2/2011 | Ansari | |
| 2011/0053675 | A1 * | 3/2011 | Aoki et al. | 463/20 |
| 2011/0183739 | A1 * | 7/2011 | Ansari et al. | 463/16 |
| 2011/0281628 | A1 | 11/2011 | Sieka | |
| 2011/0319152 | A1 | 12/2011 | Ross et al. | |
| 2012/0289306 | A1 * | 11/2012 | Kryuchkov et al. | 463/20 |
| 2013/0012317 | A1 | 1/2013 | Kryuchkov et al. | |
| 2013/0157742 | A1 * | 6/2013 | Pacey et al. | 463/20 |
| 2013/0165205 | A1 * | 6/2013 | Collette et al. | 463/20 |
| 2013/0184064 | A1 | 7/2013 | Manning et al. | |

* cited by examiner

WAGERING GAME WITH IMAGES HAVING DYNAMICALLY CHANGING SHAPES

CROSS-REFERENCE TO RELATED APPLICATION

This application claims the benefit of U.S. Provisional application No. 61/666,653, filed Jun. 29, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to gaming apparatus and methods that display images having dynamically changing paths.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to aspects of the present invention, gaming apparatus and methods display images having dynamically changing shapes. For example, in one embodiment, a wagering game displays three-dimensional reel images having dynamically changing paths.

According to one embodiment, a gaming system includes a display device configured to display a screen for a wagering game. The screen presents at least one reel and a graphical object. The at least one reel indicates a randomly determined outcome for the wagering game. The screen presents a graphical interaction between the graphical object and the at least one reel. The at least one reel changes from a first shape to a second shape in response to the graphical interaction between the graphical object and the at least one reel. The gaming system also includes a processor configured to determine the second shape for the at least one reel according to a physical simulation. The physical simulation programmatically associates the at least one reel and the graphical object with non-rendered rigid body objects and conducts a simulated interaction between the rigid body objects to determine how the at least one reel changes in the graphical interaction.

In some cases, the first shape may be defined by a first spline and the second shape may be defined by a second spline. The first spline is defined by one or more curves passing through a first set of control points. The second spline is defined by one or more curves passing through a second set of control points. The processor is configured to determine the second set of control points according to the physical simulation. In addition, the physical simulation may programmatically associate the first set of control points and the graphical object with the rigid body objects and may conduct a simulated interaction between the rigid body objects to determine how the at least one reel changes in the graphical interaction.

In other cases, the screen may present the at least one reel and the graphical object in a rendered three-dimensional environment, and the physical simulation conducts a simulated three-dimensional interaction between the rigid body objects. In addition, the at least one reel may be disposed in a foreground of the three-dimensional environment, and the screen presents the graphical object moving from a first position in a background of the three-dimensional environment to a second position in the foreground, where the graphical object interacts with the at least one reel by moving to the second position.

In another embodiment, a gaming system includes a display device configured to display a screen for a wagering game. The screen presents at least one reel and a graphical object. The at least one reel indicates a randomly determined outcome for the wagering game. The at least one reel has a first shape defined by a first spline. The first spline is defined by one or more curves passing through a first set of control points. The screen presents an interaction between the graphical object and the at least one reel. The gaming system also includes a processor configured to determine, in response to the interaction between the graphical object and the at least one reel, a second shape for the image by determining a second set of control points for a second spline that defines the second shape. The screen presents the at least one reel changing from the first shape to the second shape.

In yet another embodiment, a gaming system includes a display device configured to display a screen for a wagering game. The screen presents a first image. The first image follows a first spline. The first spline is defined by one or more curves passing through a first set of control points. The gaming system also includes a processor configured to determine a second set of control points to define a second spline for the first image. The screen displays the first image transitioning from following the first spline to following the second spline.

In some cases, the screen presents a graphical interaction involving the first image, and the processor is configured to determine the second set of control points in response to the graphical interaction involving the first image. The processor may be configured to determine the second set of control points according to a physical simulation, the physical simulation programmatically associating the first image with non-rendered rigid body objects and conducting a simulated interaction with the rigid body objects based on the graphical interaction. The physical simulation may programmatically associate the first set of control points with the rigid body objects and conduct the simulated interaction to determine how the rigid body objects change based on the graphical interaction, where the second set of control points are determined by the change in the rigid body objects. The graphical interaction on the screen may occur between the first image and a second image. Alternatively, the gaming system further includes a player input device configured to receive an input from a player, where the input causes the graphical interaction with the first image.

In a further embodiment, one or more physical machine-readable storage media include instructions which, when executed by one or more processors, cause the one or more processors to perform operations including: determining a first set of control points to define a first spline for a first image, the first spline being defined by one or more curves passing through the first set of control points, the first image following the first spline; displaying the first image on a screen for a wagering game; determining a second set of control points to define a second spline for the first image, the second spline being defined by one or more curves passing through the second set of control points; and changing the first image on the screen to follow the second spline.

In some cases, the operations performed by the one or more processors further comprise displaying a graphical interaction involving the first image, wherein determining the second set of control points occurs in response to the graphical interaction involving the first image. The operations performed by the one or more processors may include programmatically associating the first image with non-rendered rigid body objects and conducting a simulated interaction between the rigid body objects based on the graphical interaction, wherein the second set of control points are determined from the simulated interaction. The operations performed by the one or more processors may include programmatically associating the first set of control points with non-rendered rigid body objects and conducting a simulated interaction to determine how the rigid body objects change based on the graphical interaction, the second set of control points being determined by the change in the rigid body objects. The graphical interaction on the screen may occur between the first image and a second image. Alternatively, the operations performed by the one or more processors further comprise receiving an input from a player and determining the graphical interaction from the input.

Additional aspects of the invention will be apparent to those of ordinary skill in the art in view of the detailed description of various embodiments, which is made with reference to the drawings, a brief description of which is provided below.

Figure 1:
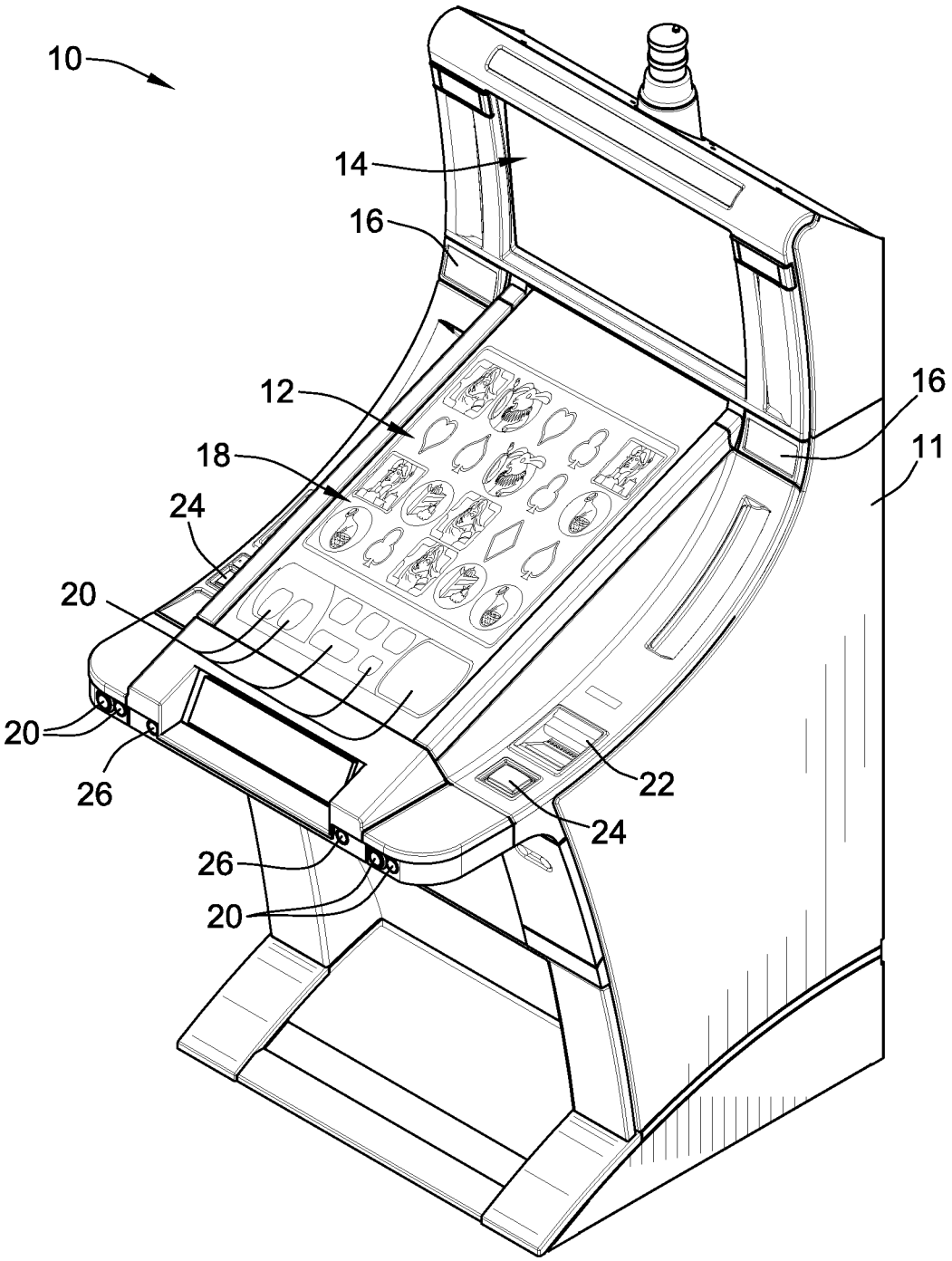
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
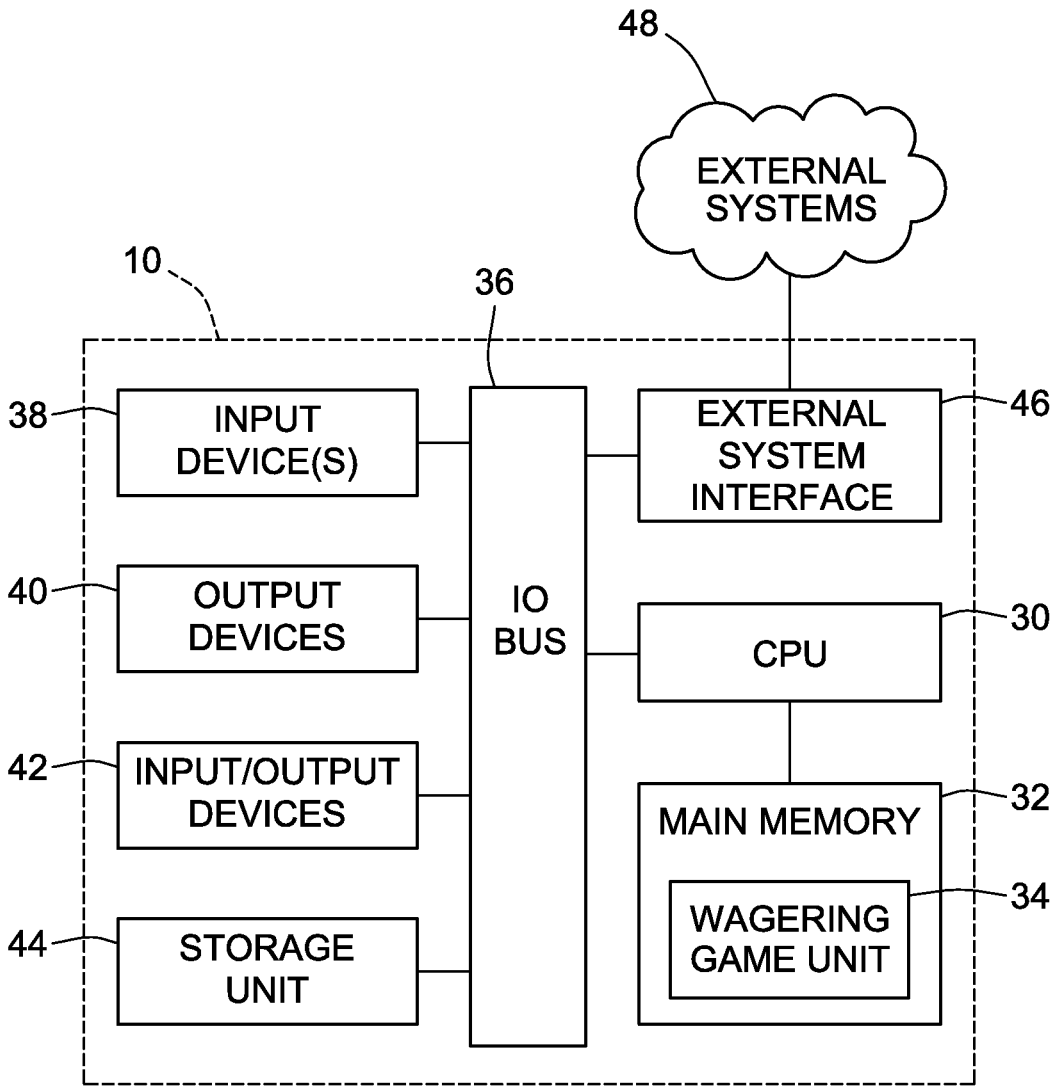
FIG. 2 PRIOR ART
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
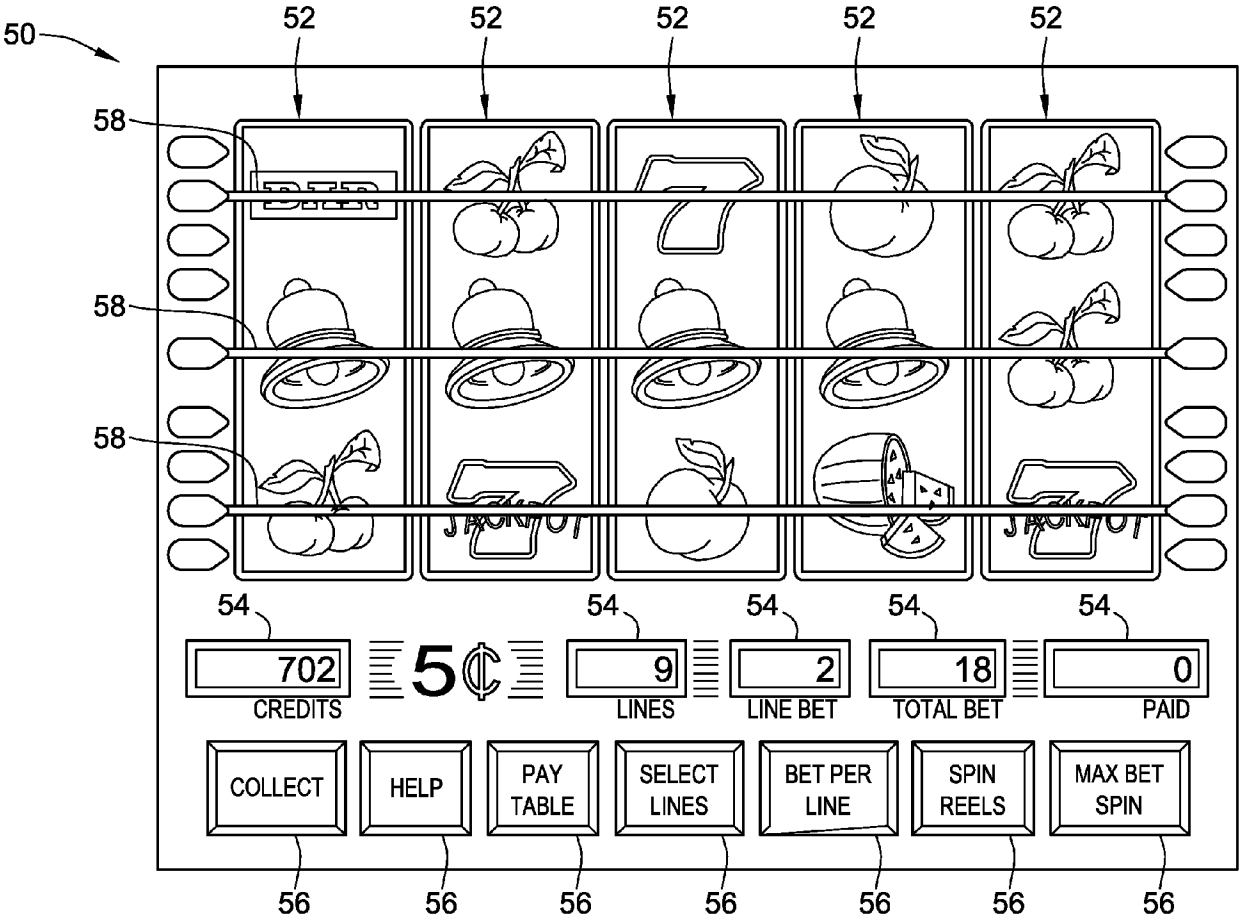
FIG. 3 PRIOR ART
FIG. 3 is an image of an example basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

As shown in FIG. 3, the symbol-bearing reels 52 of the basic-game screen 50 are displayed as linear and vertical columns in a side-by-side arrangement. In the illustrated example, the arrangement results in a two-dimensional, three-by-five array of symbols. When the reels 52 are rotated in response to a wager, the symbols on the reels 52 appear to move, i.e., up or down, along the vertical and linear columns defined by their respective reels. When the reels 52 stop rotating, their symbols appear in the same three-by-five array. Video presentations of reels have traditionally attempted to simulate the operation of mechanical reels. As such, video presentations have been typically limited to showing reels, such as the reels 52, as linear and vertical columns in a side-by-side arrangement.

Figure 4A:
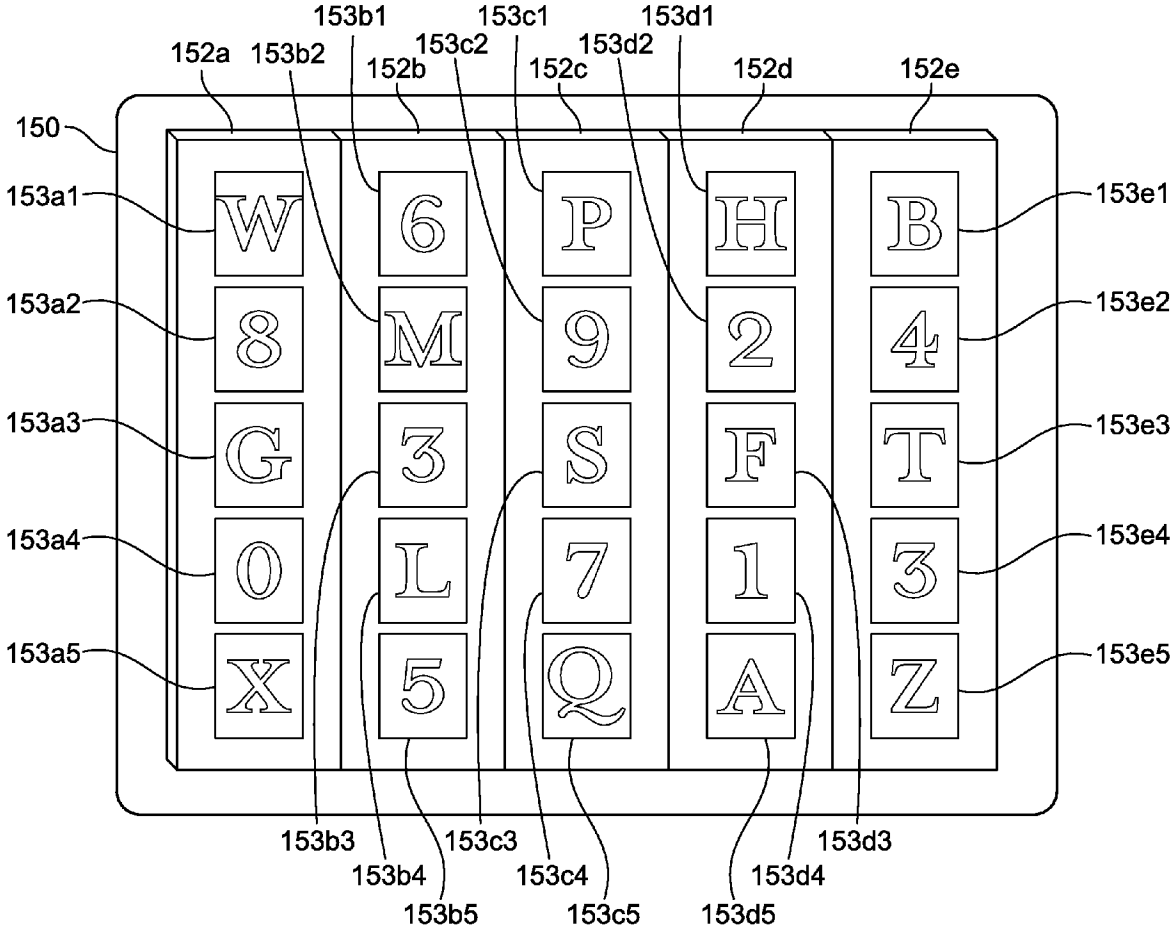
FIG. 4A is an image of an example game screen of a wagering game displayed on a gaming terminal, employing reels having dynamically changing paths according to an embodiment of the present invention.

FIG. 4A illustrates an example image of a game screen 150, which may also be displayed on the primary display area 12 or the secondary display area 14 of the gaming terminal 10. The game screen 150 includes reels 152*a-e* (collectively referred to as reels 152) bearing reel symbols 153*a*1-*a*5, 153*b*1-*b*5, 153*c*1-*c*5, 153*d*1-*d*5, and 153*e*1-*e*5 (collectively referred to as reel symbols 153). Although the reels 152 as shown in FIG. 4A may appear to be similar to the reels 52 of FIG. 3, the reels 152 are not limited to the side-by-side arrangement of linear and vertical columns of the reels 52. In addition, the symbols 153 on the reels 152 are not limited to the linear movement imposed by the linear and vertical columnar shape of the reels 52. According to aspects of the present invention, the game screen 150 employs video animation to dynamically change the reels 152 so that they may follow changing paths and have different shapes. The changing paths of the reels 152, in addition to the movement of the symbols 153 along the reels 152, makes the game screen 150 visually interesting and enhances the entertainment value of the gaming terminal 10. The ability to modify the visual characteristics of the reels 152 allows the gaming terminal 10 to incorporate a greater variety of gameplay features through the game screen 150.

For example, the reels 152 may dynamically transition from the arrangement of vertical and linear columns shown in FIG. 4A to any of the paths shown in FIGS. 4B-F. In particular, the reels 152 in FIG. 4B remain side-by-side but now follow curved paths. In one embodiment, the reels 152 may follow the vertical and linear paths shown in FIG. 4A, and in response to a wager, the reels 152 dynamically transition to the curved paths shown in FIG. 4B. As the paths of the reels 152 change, the symbols 153 on the reels 152 may simultaneously move along the changing shapes of their respective reels 152 until the symbols 153 stop in positions that determine the outcome of the wagering game. The speed of the movement of the symbols 153 along the path of the reels 152 may also be varied for additional visual effect.

In other embodiments, the paths of the reels 152 change at random times or in response to other events or aspects of the wagering game. In other words, a wager is not necessary to trigger changes to the shape of the reels 152. For example, the reels 152 may continuously change shape as a visual effect to attract players when the gaming terminal is idle. In another example, the reels 152 follow the vertical and linear paths shown in FIG. 4A when the player is playing a basic game, but if the player earns a bonus game, the reels 152 may change shape to visually signal bonus gameplay. In yet another example, the gaming terminal 10 may provide different basic games, e.g., with different pay tables, gameplay features, etc., and the reels 152*a-e* may change paths in response to a selection of a particular basic game by the player.

Figure 4B:
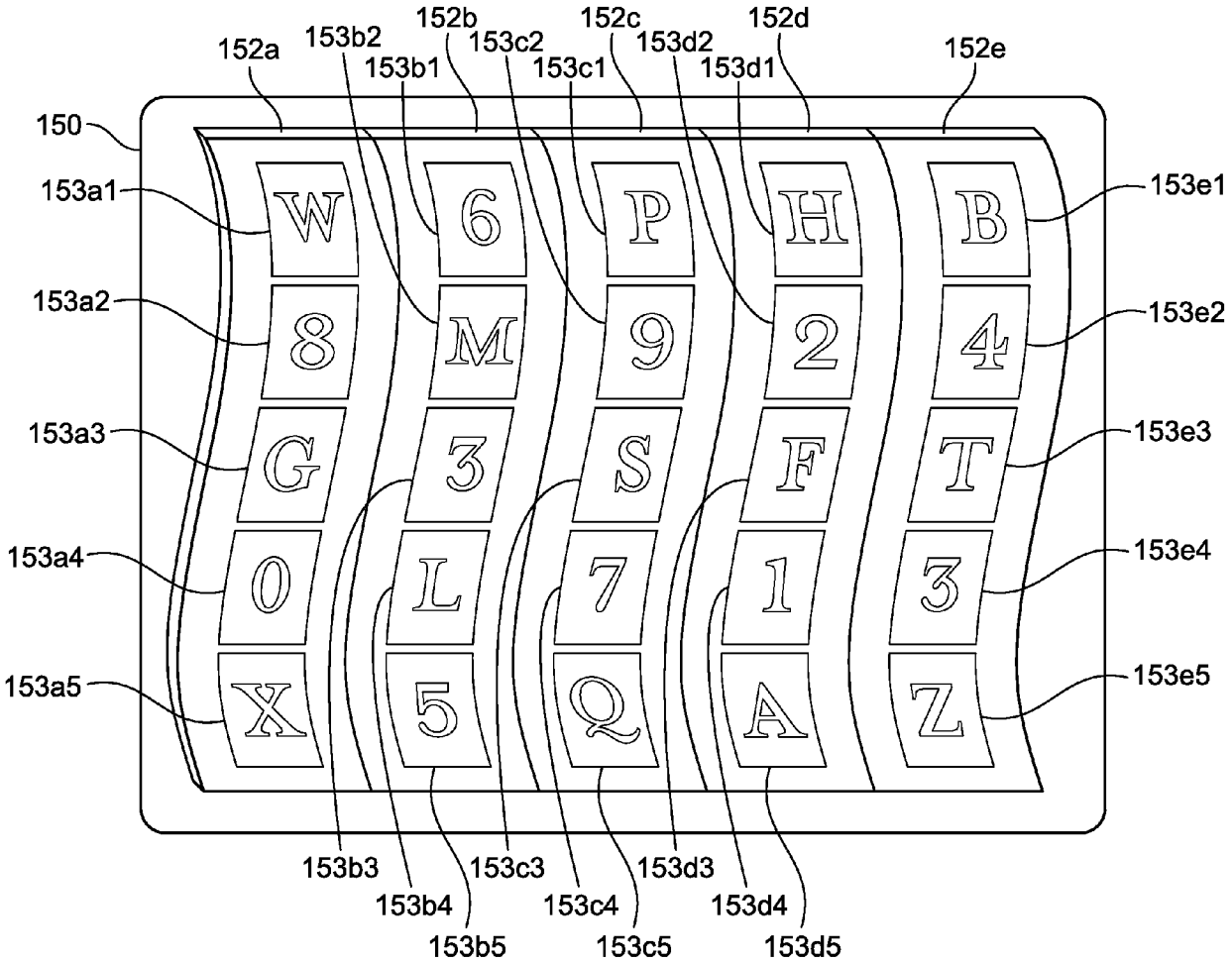
FIG. 4B is an image of the example game screen of FIG. 4A, illustrating example curved paths that the reels may dynamically follow according to an embodiment of the present invention.

While the reels 152*a-e* in FIG. 4B all appear to have similar curved shapes, different subsets of the reels 152*a-e* can have varying respective curved shapes in other embodiments. For example, FIG. 4C shows that the reels 152*a-b* have a first curved shape while the reels 152*c-e* have a different second curved shape.

Figure 4C:
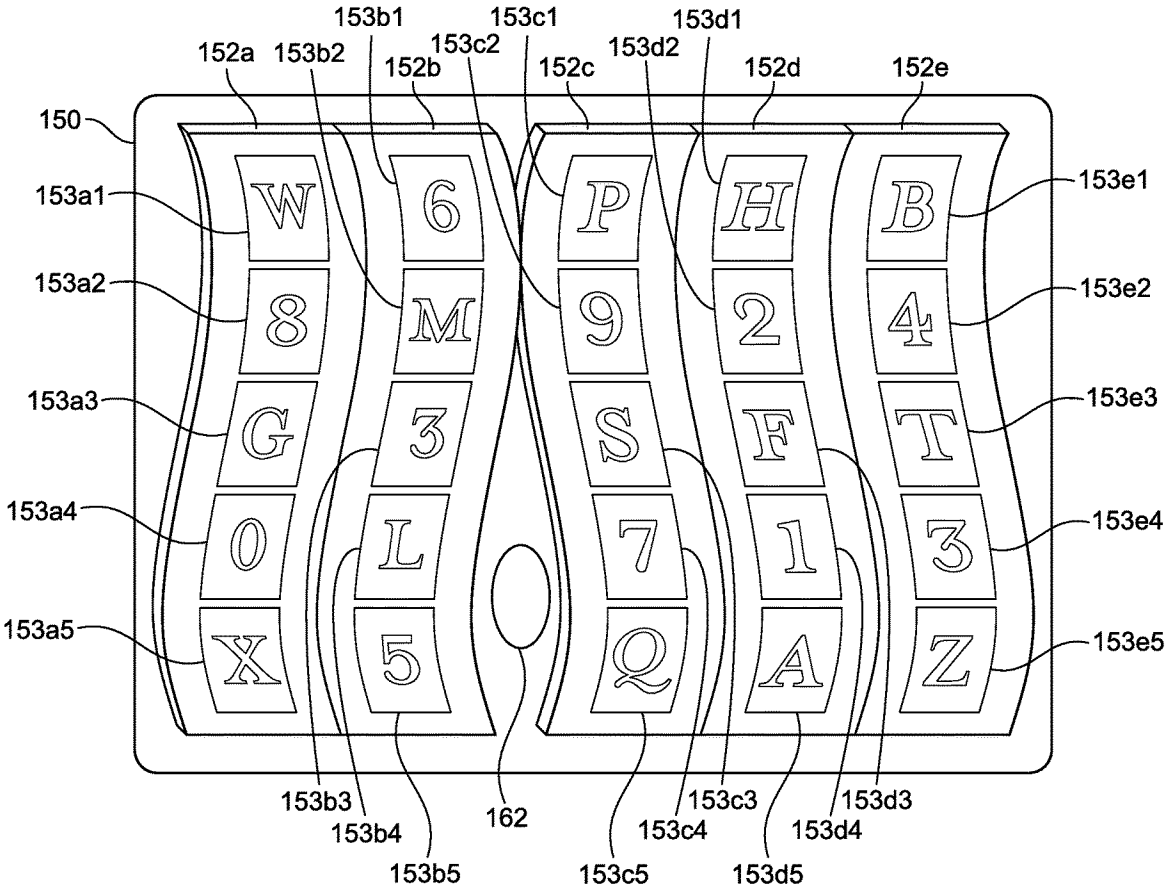
FIG. 4C is an image of the example game screen of FIG. 4A, illustrating a graphical object and example curved paths that the reels may dynamically follow in response to an interaction with the graphical object according to an embodiment of the present invention.

Furthermore, FIG. 4C shows that the game screen 150 is not limited to displaying the reels 152*a-e* and may include other graphical objects. In particular, the game screen 150 includes a graphical object 162. The shapes of the reels 152*a-e* accommodate the shape of graphical object 162. In one embodiment, the reels 152*a-b* and 152*c-e* in FIG. 4C dynamically change shape, e.g., bend in opposing directions, in response to the appearance of the graphical object 162. The change in the reel paths ensures, for example, that the symbols 153 on the reels 152 remain visible and are not covered by the graphical object 162. The graphical object 162 may be associated with the theme of the wagering game. Additionally, the graphical object 162 may be used for some aspect of the gameplay. For example, it may appear as a part of a bonus game, indicate enhanced awards, etc.

Figure 4D:
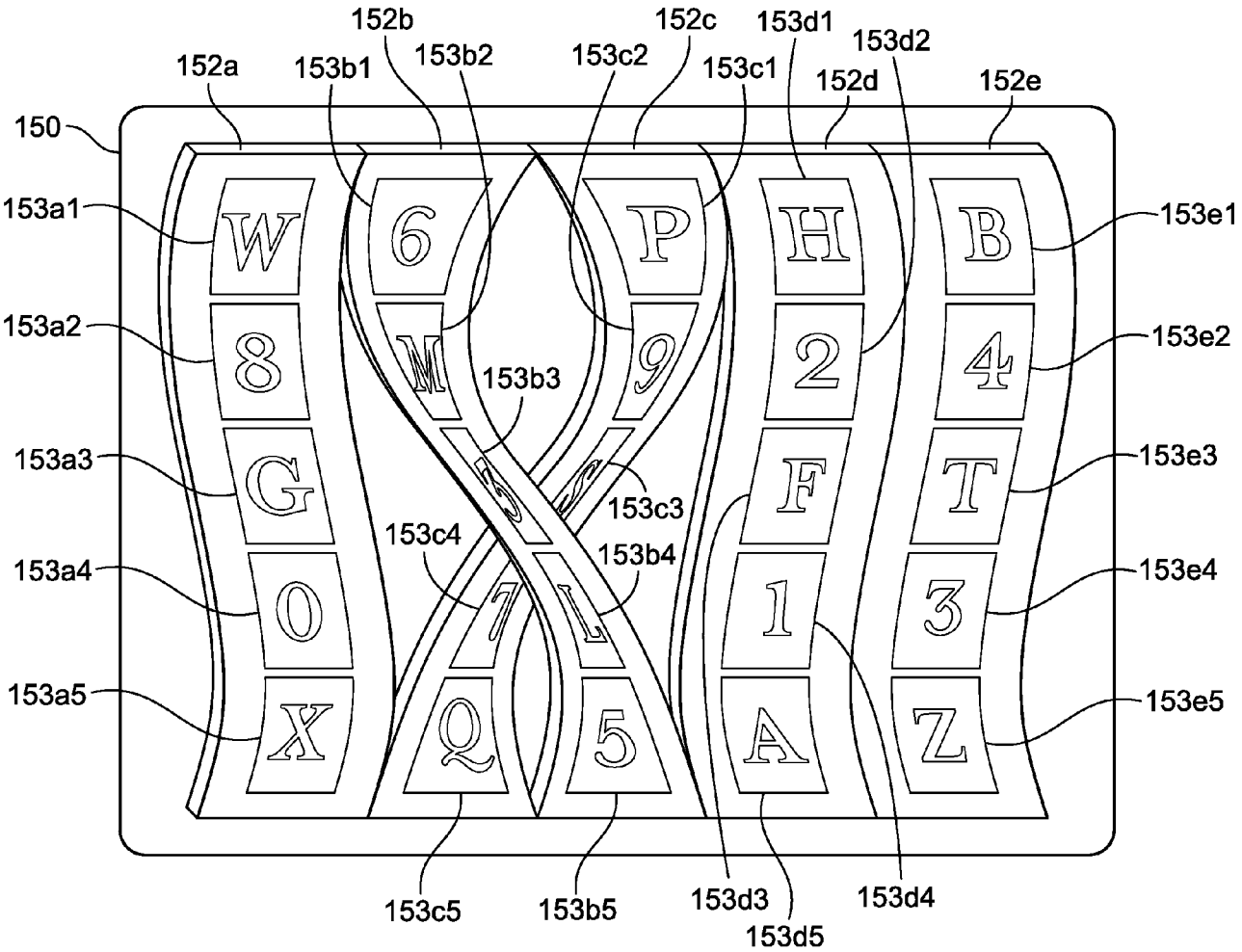
FIG. 4D is an image of the example game screen of FIG. 4A, illustrating example paths that the reels may dynamically follow when interacting with each other according to an embodiment of the present invention.

While the reels 152*a-e* in FIG. 4A-C may be non-overlapping, FIG. 4D illustrates an example in which the paths of the reels 152*b* and 152*c* interact with each other to overlap and criss-cross. In one embodiment, in response to a wager, the paths of the reels 152*b* and 152*c* change while the symbols 153 move along the reels 152 to determine the outcome of the wagering game. As such, the symbols 153*b*4 and 153*b*5 on the reel 152*b* effectively switch positions with the symbols 153*c*4 and 153*c*5 on the reel 153*c* even though the symbols 153*b* and 153*c* remain on their respective reels 153*b* and 153*c*. The change in reel paths in FIG. 4D changes the arrangement of the symbols 153 relative to the paylines and appears to change the outcome(s). In alternative embodiments, reels may cross or otherwise overlap other reels more than once.

The relative movement and positioning of the reels 152*b* and 152*c* shows that the reels 152 on the game screen 150 can move three-dimensionally. In addition to moving horizontally and vertically along the plane of the display area, the reels 152*a-e* appear to move into and out of the plane of the display area. Thus, according to aspects of the present invention, the reels 152*a-e* shown in the game screen 150 may follow any three-dimensional path.

Figure 4E:
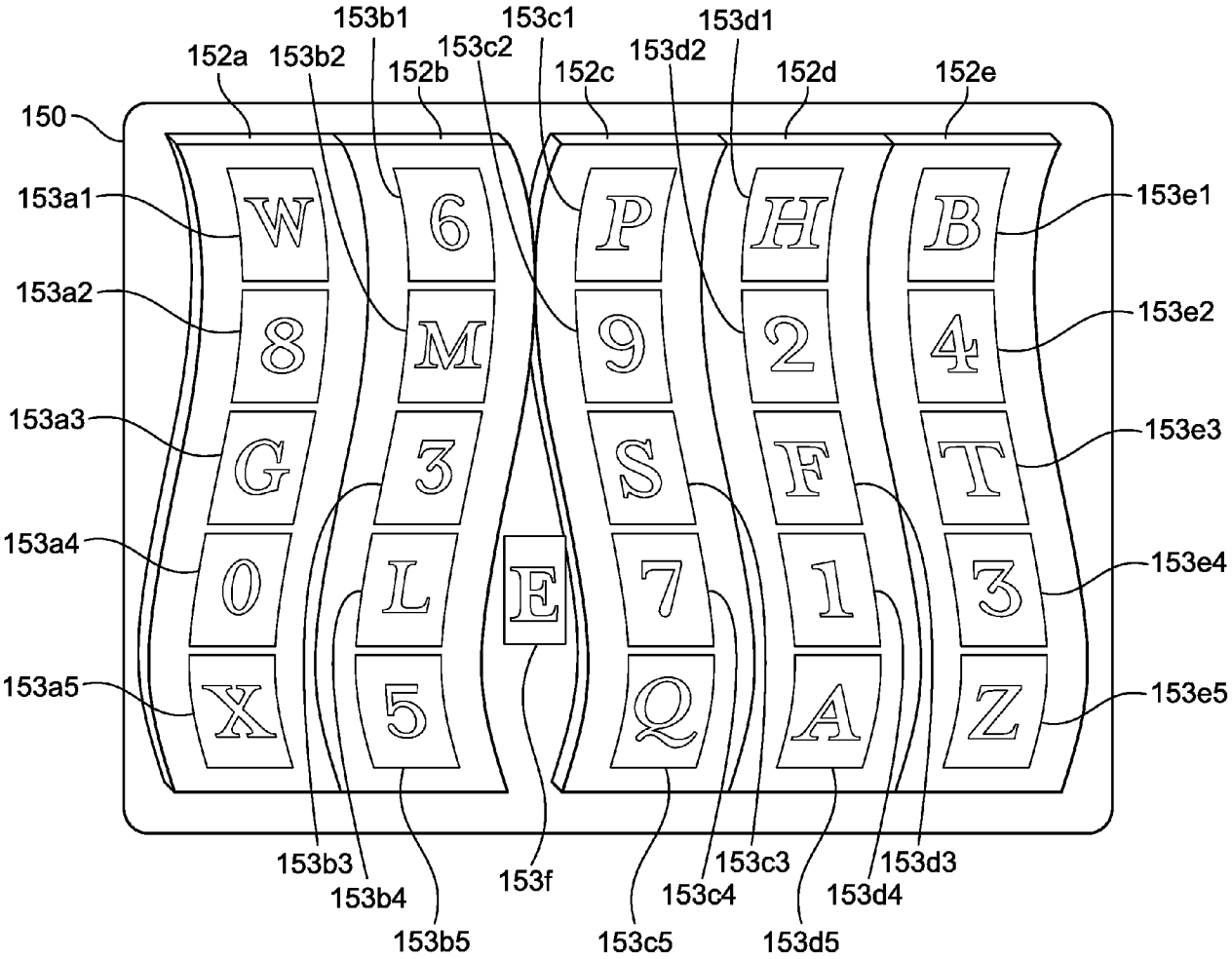
FIGS. 4E-F are images of the example game screen of FIG. 4A at two different times, illustrating example paths that the reels may dynamically follow and resulting changes to the reel symbols according to an embodiment of the present invention.
Figure 4F:
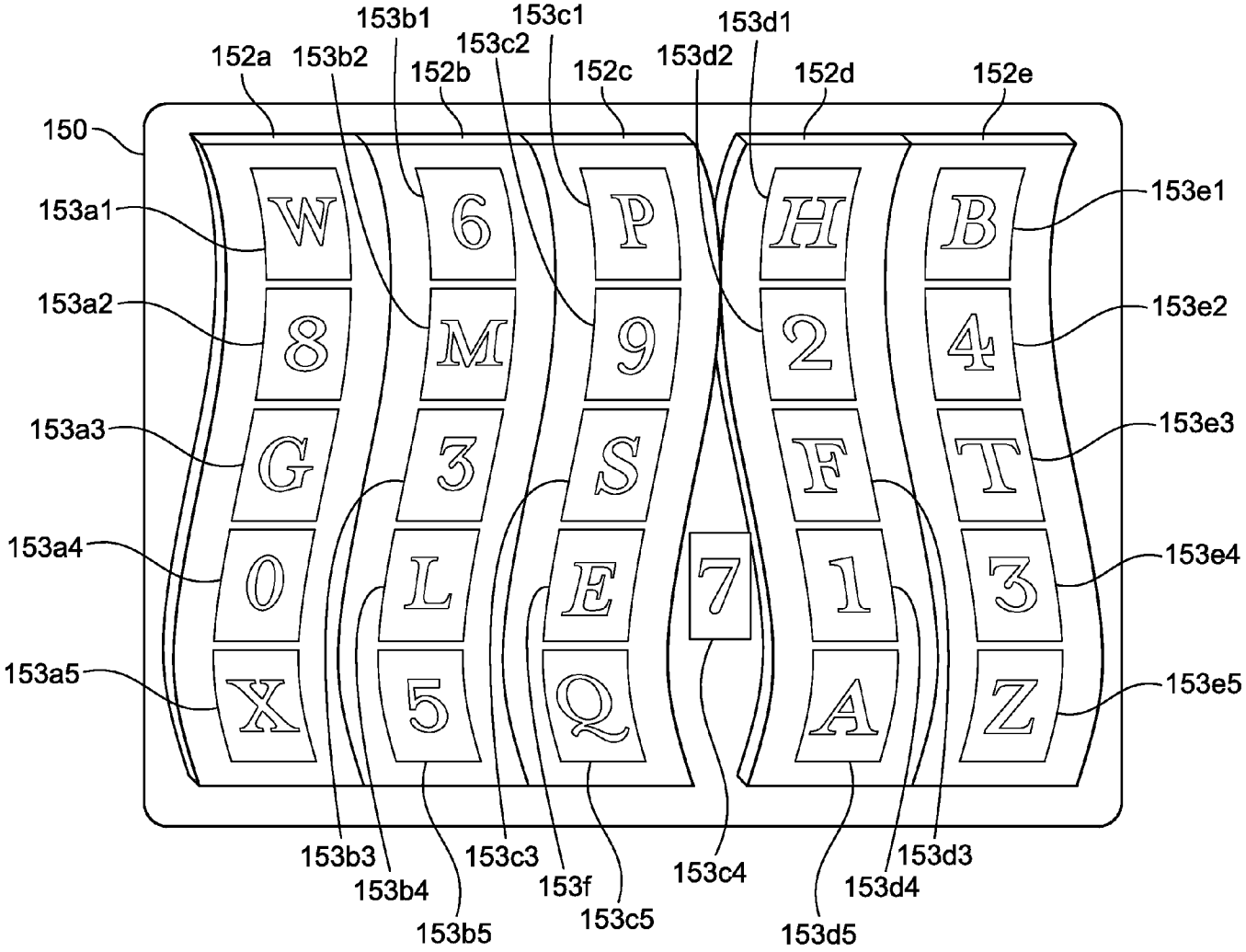

In the embodiments above, the symbols 153 remain on, and move with, their respective reels 152 even as the reels 152 transition between paths. On the other hand, FIGS. 4E-F illustrate an embodiment in which the symbols 153 on a given reel 152 may change with the change in the path of the reel. FIG. 4E shows that the reels 152*a-b* have a first curved shape while the reels 152*c-e* have a different second curved shape. FIG. 4E also shows, however, that the game screen 150 includes a stand-alone reel symbol 153*f* positioned between the reels 152*b* and 152*c*. The reels 152*b* and 152*c* also curve to accommodate the shape of isolated real symbol 153*f*.

FIG. 4F shows that the reel 152*c* has transitioned to follow a new path. The new path of the reel 152*c* passes over the position of the reel symbol 153*f*. As a result, the symbol 153*c*3 previously positioned on the reel 152*c* as shown in FIG. 4E is replaced with the reel symbol 153*f*. Meanwhile, the symbol 153*c*3 is now a stand-alone reel symbol positioned between the reels 152*c* and 152*d*. The outcome of the wagering is evaluated according to the reel symbols 153 on the reels 152 and their arrangement relative to paylines. Therefore, replacing the symbol 153*c*3 with the symbol 153*f* on the reel 152*c* appears to alter the outcome(s) of the wagering game. The symbol 153*f* may be introduced at random times and/or in response to an event in the wagering game, such as the appearance of one or more triggering symbols on the reels.

According to aspects of the present invention, the path of the reels, such as the reels 152 in the embodiments above, are based on programmatically generated splines, where the path of a reel is defined by a series of control points. Splines, in general, combine one or more curves to smoothly fit the series of control points. For example, a spline may employ a Bezier curve, which is a parametric curve frequently used in computer graphics and related fields.

For a given reel, a corresponding spline fits curves to a set of defined control points and the reel follows a path defined by the fit curves. In effect, the set of control points limits the possible paths that the reel may follow. Any of the defined control points, however, can be altered to generate a new set of possible paths for the reel. In addition, various parameters for the spline can be set to define the manner in which the curves fit the control points. For example, one parameter may define a tension between control points. In particular, a cardinal spline is defined by a set of control points and a tension parameter. A greater tension generally results in a smaller rate of curvature between two control points. A lower tension generally results in a greater rate of curvature between control points and gives the appearance of greater slack. The tension can be varied for the curves fitting the different pairs of control points to provide a desired visual effect, e.g., more curvature in one section of the reel and less curvature in another section of the reel. For some splines, a large amount of slack may even result, for example, in an oscillating shape between the control points.

A reel appears to move when its path transitions between different splines. For example, the reel 152*b* in FIG. 4B follows a first spline defining the a first curved path and then can move until it follows a second spline defining a second curved path shown in FIG. 4C. The first spline is defined by a first set of control points and the second spline is generated according to a second set of control points. As described above, the graphical object 162 appears in the game screen shown in FIG. 4C. As such, the second set of control points are set so that they accommodate the position of the graphical object 162 and prevent the reel 152*b* from overlapping the graphical object 162 when its path changes from the first spline to the second spline. In general, the control points apply constraints on the paths of the reels and can limit movement of the reels in any degree of freedom. Thus, the reel 152*b* can move again to follow a path defined by a third spline, but the third set of control points continues to keep the reel 152*b* from moving into the space defined by the graphical object 162.

In some embodiments, the paths of the reels are randomly determined and dynamically rendered in real time, i.e., "on the fly." The basic definition of the spline may be programmed in advance, but the definition is altered to generate new paths for the reels. At runtime, the path of the reels can be altered for any gameplay by repositioning the control points of the splines programmatically. Advantageously, the use of splines provides a flexible approach for dynamically generating any number of possible reel paths during actual gameplay. Alternatively, the paths of the reels may be determined in advance. In particular, during the setup of the game screen, the paths of the reels may be generated in batch by varying spline definitions and then the generated paths are stored for use by the game screen.

Figure 5A:
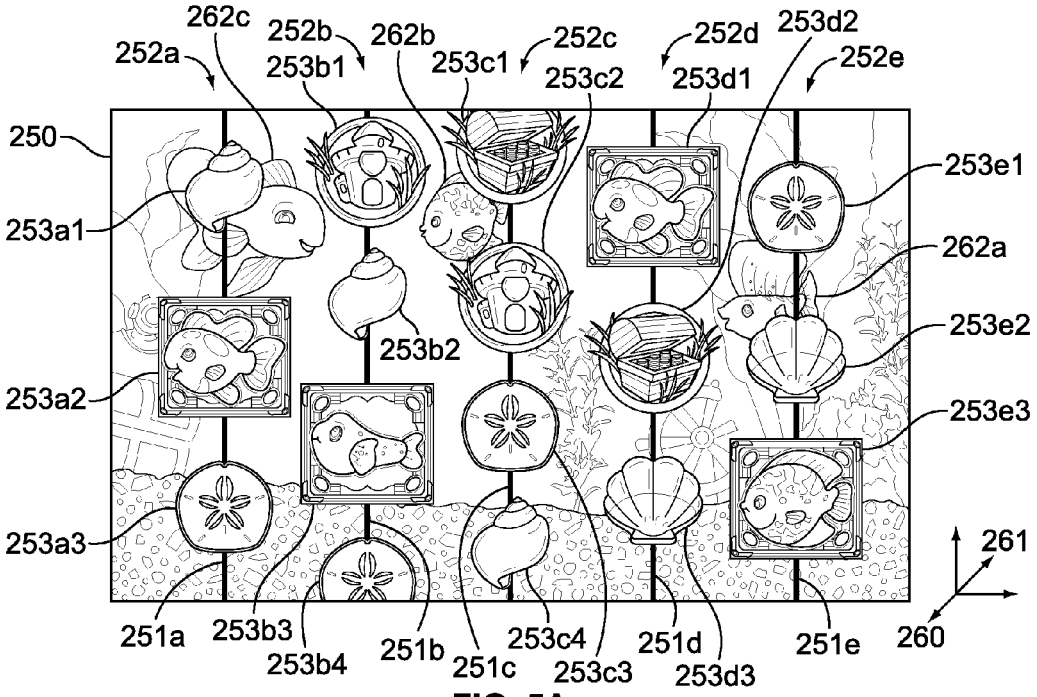
FIG. 5A-B is an image of an example game screen of a wagering game displayed on a gaming terminal at two different times, employing reels in a three-dimensional environment having dynamically changing paths defined by splines that change in response to a graphical object according to an embodiment of the present invention.
Figure 5B:
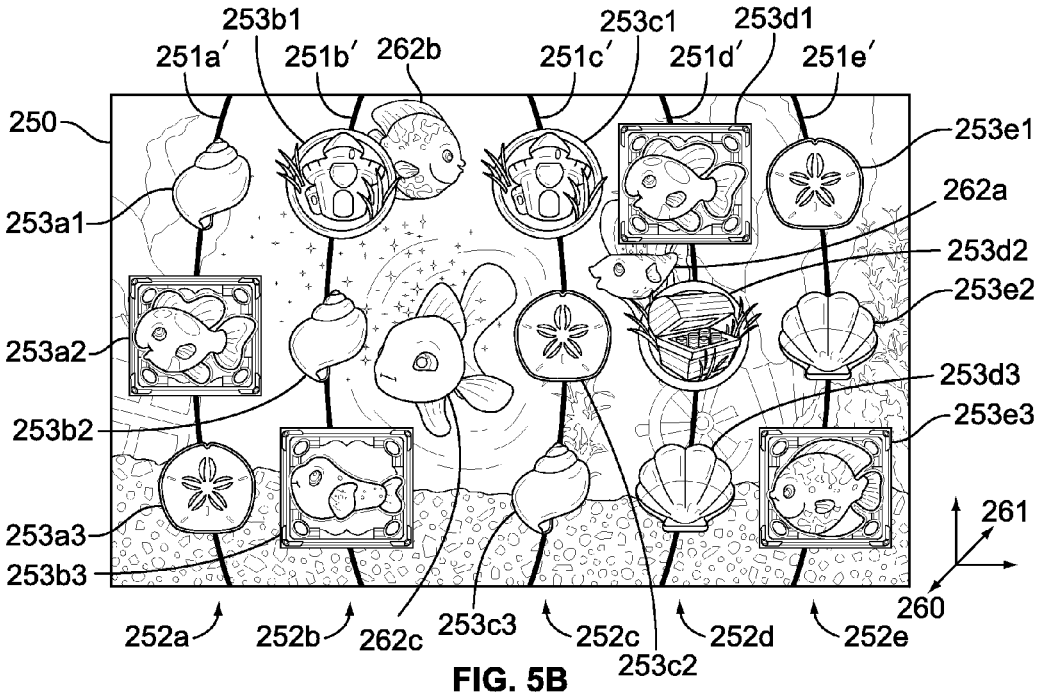

FIGS. 5A-B illustrate a game screen 250, which may also be displayed on the primary display area 12 or the secondary display area 14 of the gaming terminal 10. The game screen 250 includes reels 252*a-e* (collectively, reels 252) with symbols 253*a*1-*a*3, 253*b*1-*b*4, 253*c*1-*c*4, 253*d*1-*d*3, and 253*e*1-*e*3 (collectively, symbols 253). As shown in FIG. 5A, the reels 252*a-e* are aligned along splines represented by lines 251*a-e*, respectively. Similar to the embodiments described above, in response to a wager, the symbols 253 move along the paths of their respective reels 252 until the symbols 253 stop in positions that determine the outcome(s) of the wagering game.

In the example of FIGS. 5A-B, the game screen 250 displays a three-dimensional underwater environment. As shown in FIG. 5A, graphical objects are displayed in the background 261 of the game screen 250. In particular, the game screen 250 displays fish 262*a-c* swimming through the background 261. Meanwhile, the reels 252 are separately displayed in the foreground 260. Thus, the fish 262*a-c* in FIG. 5A appear to be swimming behind the reels 252.

In FIG. 5B, however, the game screen 250 displays the fish 262*c* in the background 261 moving from behind the reels 252*a-e* to the foreground 260. In particular, the fish 262*c* attempts to swim between the reels 252*b* and 252*c*. To accommodate the fish 262*c*, the paths of the reels 252*a-e* change dynamically. Specifically, the paths of the reels 252*a-e* transition from the splines 251*a-e* shown in FIG. 5A to splines 251*a*'-*e*' shown in FIG. 5B.

According to aspects of the present invention, graphical objects, such as the fish 262*a-c*, can move three-dimensionally through the environment displayed by the game screen. As such, the graphical objects in the environment can interact with the reels, such as the reels 252*a-e*, and cause any of the reel paths to change.

In some embodiments, the interaction between the graphical objects and the reels may appear to alter the outcome(s) of the wagering game. For example, FIG. 5A shows that the reel 252*b* includes symbols 253*b*1 (sea castle), 253*b*2 (shell), 253*b*3 (fish), and 253*b*4 (sand dollar). FIG. 5A also shows that the reel 252*c* includes 253*c*1 (treasure chest), 253*c*2 (sand castle), 253*c*3 (sand dollar), and 253*c*4 (shell). The symbols 253*b*1-*b*4 and 253*c*1-*c*4 are positioned relative to the other symbols 253*a*1-*a*3, 253*d*1-*d*3, and 253*e*1-*e*3 in an arrangement that can be conventionally evaluated to determine the outcome(s) of the wagering game.

As FIG. 5B illustrates, however, the fish 262*c* is randomly selected to interact with the reels 252*b* and 252*c* to change the paths of the reels 252*b* and 252*c* and correspondingly the arrangement of the symbols 253*b*1-*b*4 and 253*c*1-*c*4. In particular, the fish 262*c* causes the paths of the reels 252*b* and 252*c* to stretch and bow three-dimensionally outward. The reels 252*a* and 252*d*, and 252*e* in response also change paths to a lesser extent. The stretching of the paths causes the spacing between the symbols 253*b* and 253*c* on the reels 252*b* and 252*c*, respectively, to increase. As a result, FIG. 5B shows that the symbols 253*b*1-*b*3 and 253*c*1-*c*3 have changed positions relative to the other symbols 253*a*1-*a*3, 253*d*1-*d*3, and 253*e*1-*e*3, while the symbols 253*b*4 and 253*c*4 are no longer shown on the game screen 250. The changes to the arrangement of the symbols 253*b*1-*b*4 and 253*c*1-*c*4 caused by the fish 262*c* also changes how the outcome(s) of the wagering game are evaluated.

Thus, to provide the outcome of a wagering game, a game screen may initially show the result of a reel spin and then alter the result by showing an interaction between one or more graphical objects, such as the fish 262*c*, and the reels. This interaction changes the position of the reel symbols relative to the paylines. The interaction between the one or more graphical objects may also occur in a rendered three-dimensional environment.

Although the graphical object appears to alter the outcome of the wagering game, the final outcome in some embodiments may be determined at the time of the wager and the interaction between the graphical object and the reels may be one of a plurality of randomly selected ways to display the predetermined outcome. In other words, the final outcomes in some embodiments do not actually depend on the interaction between the graphical object and the reels. The outcome would generally be the same regardless of how the outcome is displayed on the game screen with changing reel paths.

Figure 6:
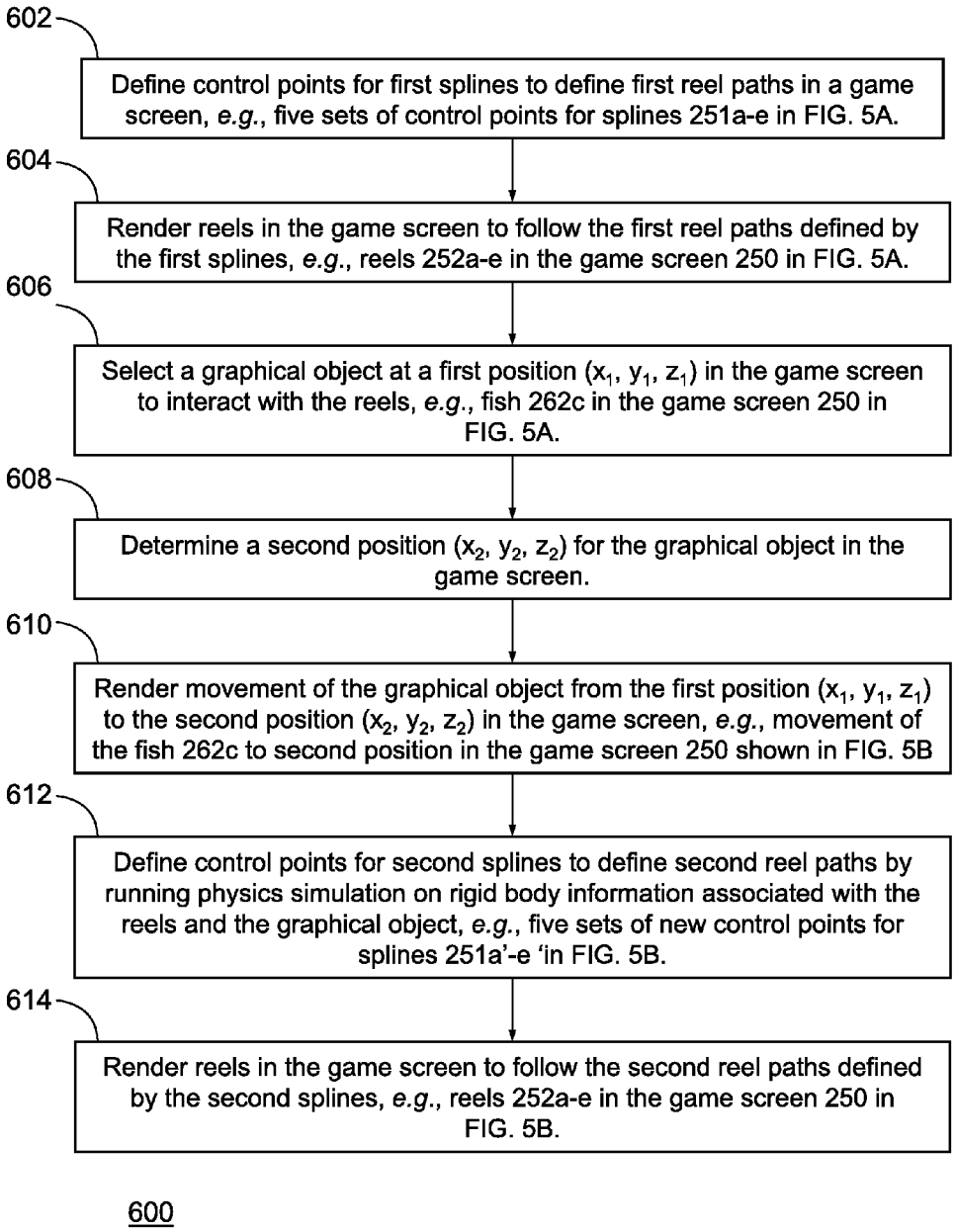
FIG. 6 is an example approach for determining dynamically changing shapes for images in an example game screen of a wagering game displayed on a gaming terminal according to an embodiment of the present invention.

FIG. 6 illustrates an example approach 600 for determining dynamically changing shapes for images in a game screen, e.g., determining the paths of the reels 252 as shown in FIGS. 5A-B. The CPU 30 of the gaming terminal 10, for example, may be employed to execute the approach 600. In act 602, five sets of control points are defined for the splines 251*a-e*. Where splines are defined, it is understood that other parameters, such as tension, may also be specified. As described above, each of the splines 251*a-e* include one or more curves that fit its respective set of control points. In act 604, the reels 252*a-e* are rendered on the game screen 250 to follow the splines 251*a-e*, as shown in FIG. 5A. Each of the control points for the splines 251*a-e* is programmatically associated with a sphere (or other shaped object) that has rigid body information. The spheres are not rendered on the game screen 250, but each sphere programmatically occupies its own space and has geometric properties within the three-dimensional environment of the game screen 250. Each reel symbol 253 may be associated with a respective one of the control points for the spline of its respective reel 252. For example, the reel symbols 253*a*1-*a*3 may each be associated with a respective one of three control points that defines the spline 251*a* for the reel 252*a*. As such, each reel symbol 253 is programmatically associated with a respective sphere occupying space at the location of the reel symbol 253 in the three-dimensional environment.

The game screen 250 also includes the fish 262*a-c*, which swim in the background 261, as shown in FIG. 5A. In act 606, the fish 262*c* located at a first position (xi, yi, zi) is selected to interact with the reels 252*a-e*. Like the control points for the splines 251*a-e*, the fish 262*c* is also programmatically associated with a sphere (or other shaped object) that has rigid body information and occupies space in the three-dimensional environment. In act 608, a second position (x2, y2, z2) is determined, and in act 610, the fish 262*c* is shown to move from the first position (xi, yi, zi) to the second position (x2, y2, z2) in the three-dimensional environment of the game screen 250.

By moving to the second position (x2, y2, z2), the fish 262*c* moves into space occupied by the reels 252*b* and 252*c*. In act 612, five sets of control points are defined for the splines 251*a*'-*e*', which in turn define new paths for the reels 252*a-e* in response to the new position of the fish 262*c*.

According to one embodiment, the rigid body and spatial information associated with the spheres for the control points and the fish 262*c* are employed in a physics simulation. In particular, the simulation determines how the spheres associated with the reels 252 would behave in a three-dimensional world according to physical laws if the sphere associated with the fish 262*c* were to move to the specified position between the reels 252*b* and 252*c*. The physics simulation determines final positions for the spheres associated with the reels 252, and the final positions are used to define the five sets of control points in act 612.

According to one embodiment, the physics simulation imparts the properties of cloth on the reels 252*a-e*, so that the fish 262*c* appears to part the reels 252 like curtains when it moves into the foreground 260. Various parameters may be employed to constrain aspects of the reels 252. For example, if the reels 252 have the properties of cloth, specified parameters, e.g., higher tension values, may prevent the simulation from twisting the reels 252, thereby ensuring that the reel symbols 253 remain visible on one side of the reels 252. It is understood, however, that the reels 252 may have the properties of other materials and may behave according to different parameters. For example, the reels 252 may have the elastic properties of rubber or a flexible plastic.

An example of a simulation system that may be employed to apply physics to the control points is provided by Havok™ (www.havoksimulation.com). The simulation system may provide a runtime software development kit and toolset that controls the movements of objects in a two-dimensional or three-dimensional scene, e.g., by simulating the collision of the objects. The simulation system may generate the control points for the splines in real time or offline before the wagering game is played. In one embodiment, the CPU of the gaming terminal may access in real time the generated control points through an application programming interface (API) for the simulation system.

In act 614, the reels 252*a-e* are rendered on the game screen 250 to follow the splines 251*a*'-*e*', as shown in FIG. 5A. In effect, when the fish 262*c* moves into the foreground 260 in the three-dimensional environment, the fish 262*c* pushes the control points associated with the reels 252*a-e* and dynamically changes the path of the reels 252*a-e* as shown in FIG. 5B.

In the example of FIGS. 5A-B, the interaction between the fish 262*c* and the reels 252 may be triggered at random times and/or in response to an event in the wagering game, such as the appearance of one or more triggering symbols on the reels. In one embodiment, the fish 262*c* may be selected by the player, e.g., by a touch screen, to cause a change in the paths of the reels 252. The reel game is combined with aspects of a picking game, where the player's selection in the picking game results in a change in the outcome of the reel game. As shown in FIGS. 5A-B, the background 261 includes a plurality of fish 262*a-c*, the visibility of which may be enhanced by making the reels 252 semi-transparent. The player can select one of the fish which then moves to the foreground to a random second location (x2, y2, z2) to change the path of the reels 252 to achieve possibly a better outcome for the wagering game. The resulting control points for the splines 251*a*'-*e*' depends on the second location (x2, y2, z2). Additionally, the rigid body information (sphere) associated with each fish 262*a-c* may vary with the size of the fish. As such, the selection of a larger fish may result in a greater change in the paths of the reels 252. Of course, other factors may also be taken into account to determine how the paths of the reels 252 change. For example, a larger wager may provide a greater number and variety of fish from which the player can select.

Although game screen 250 shown in FIGS. 5A-B triggers one of the fish 262*a-c* to alter the paths of the reels 252, it is understood that other game themes may be employed and other graphical objects/effects may alter the paths of the reels. In another aquatic theme, for example, the game screen displays reels that float along in a moving stream. The forces associated with the moving water in the stream cause the reels to change paths. Also, obstacles, such as rocks, fish, and the like, in the stream may apply additional forces to the reels to change their paths as the reels move downstream.

In another example, a game screen may display an explosion behind the reels. Like the fish 262*c* above, the explosion applies a force to the reels, resulting in a change in the control points defining the splines for the reels. Other graphical objects/effects may include wind, projectiles, other animated characters, or any object that can contact/apply a physical force to the reels.

In some embodiments, the player can provide an input to trigger a change in the paths of the reels, e.g., cause a change in control points for splines defining the paths of the reels. As described above, for example, the fish 262*c* may be selected by the player in a picking game to cause a change in the paths of the reels 252. Thus, the player may trigger a graphical object on the game screen to interact with the reels and cause a change in their paths. In some cases, the player selects the graphical object and the processor determines how the graphical object behaves and interacts with the reels. In other cases, the player selects the graphical object and manipulates it to interact with the reels, e.g., selects the graphical object via a touch screen and drags the graphical object to a position that causes it to contact the reels.

In another example, the player may interact directly with the reels to cause a change in their paths. In other words, a graphical object, like the fish 262*c*, is not required to trigger a change in the reel paths. In some cases, the player may cause the reels to change by touching an area proximate to the reels on a touch screen. For instance, the input from the player is translated into a physical force applied to the control points of the splines for the reels and the simulated result is shown on the game screen. The player's touch may appear to push the reels aside to areas around the player's touch.

In other cases, the player may touch a reel and drag portions of the reel in different directions to define a new path for the reel. For instance, the input from the player drags the control points of the splines for the reels in the different directions.

Thus, in general, a player may provide a direct or indirect input that results in a graphical interaction with aspects of the game screen, e.g., the reels or other graphical object. It is understood that the player's input is not limited to direct interaction with the reels or other graphical images through a touch screen. Other approaches for player input may include use of buttons, a mouse, a joystick, touch pad, keyboard, and/or a voice-recognition device, etc. Additional approaches may include use of a wireless controller, a gesture-sensing device, or similar device that translates the player's hand or body motions into an input on the game screen.

In other embodiments, an interaction with a graphical object and/or an input from the player is not required to cause a change in reel paths. In some cases, the processor dynamically redefines the splines mathematically, without such interaction, to achieve an effect on the reels and/or change the evaluation of the reel positions. In one example, a game screen includes a plurality of reels that follow paths defined by splines that extend vertically across the game screen, and when the reels are spinning, the reel symbols move downwardly and vertically along the reel paths. While spinning, the reel paths dynamically change to follow splines that extend horizontally across the game screen. The reel paths may change, but the orientation of the reel symbols may remain the same. As a result, the reel symbols move sideways along the new reel paths. No interaction involving a graphical object and/or player input is required; the processor automatically initiates vector math to redefine the reel paths and movement of the reel symbols during a reel spin.

Figure 7:
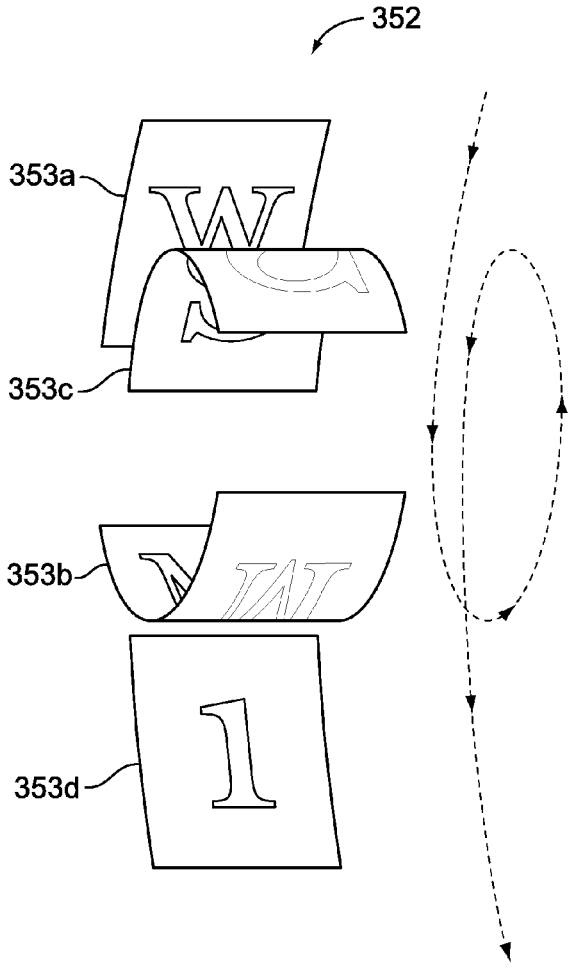
FIG. 7 is an image of an example three-dimensional path that a reel may dynamically follow according to an embodiment of the present invention.

As described above, the reels may have the properties of various materials and may behave according to different parameters. Correspondingly, the reels can also have shapes that are more complex than those shown in the previous embodiments. For example, FIG. 7 illustrates a single reel 352 that loops around as it extends downwardly. The reel symbols 353*a-d* follow the loop. In particular, as shown in FIG. 7, the symbol 353*a* ("W") moves downward toward the position of the symbol 353*b* ("M"). The symbol 353*b* enters the bottom of the loop and begins to move upwardly toward the symbol 353*c* ("S"). The symbol 353*c* is at the top of the loop and begins to move downwardly toward the symbol 353*d* ("1").

Figure 8:
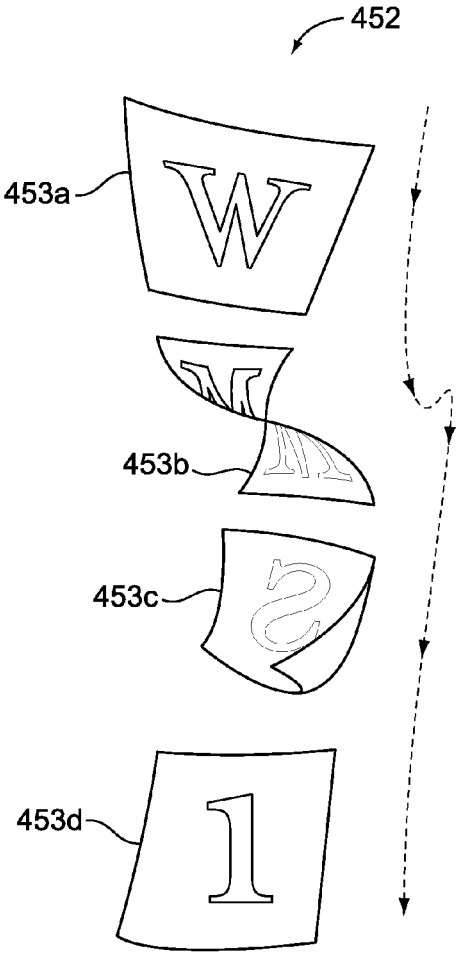
FIG. 8 is an image of another example three-dimensional path that a reel may dynamically follow according to an embodiment of the present invention.

In another example, FIG. 8 shows a single reel 452 that twists in a helical shape as it extends downwardly. The reel symbols 453*a-d* follow the helical shape. In particular, as shown in FIG. 8, the symbol 453*a* ("W") moves downward toward the symbol 453*b* ("M"). A front surface of the symbol 453*a* completely shows the letter "W." The symbol 453*b* twists as it moves downward toward the symbol 453*c* ("S"). Because it is twisted, half of the front side of the symbol 453*b* is shown and half of the back side of the symbol 453*b* is shown. Correspondingly, half of the letter "M" is shown from the front side and half of the letter "M" is shown from the back side. The symbols 453*a-d* may be semitransparent so that the letter/number on one side can be seen through the other side, or the symbols 453*a-d* have opaque sides where each side includes a letter/number. The symbol 453*c* is almost completely twisted around as it moves toward the symbol 453*d* ("1"), so that the letter "S" is shown completely from the back side. The symbol 453*d* is twisted from the orientation of the symbol 453*c* so that the number "1" is completely shown from the front side.

The looping or twisting paths of the reels 352, 452 in FIGS. 7-8 emphasize the three dimensional nature of the reels and the game screen environment. The reels 352, 452 can be employed in combination with other reels on a game screen. In addition, the paths may be the result of an interaction between the reels 352, 452 and another graphical object on the game screen, similar to the interaction shown in FIGS. 5A-B.

In summary, according to aspects of the present invention, gaming apparatus and methods display images having dynamically changing shapes. For example, in some embodiments, a wagering game displays three-dimensional reel images having dynamically changing paths. In some cases, the paths are defined by splines that are defined by one or more curves passing through a set of control points. The paths may take any shape constrained by the set of control points. In other cases, the paths change dynamically in response to interaction with other graphical objects. In further embodiments, the paths are determined by a physical simulation that associates the set of control points and the graphical object with non-rendered rigid body objects and conducts a simulated interaction between the rigid body objects to determine how the reels change.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, direct the electronic display device to display a screen presenting a graphical interaction between a graphical object and at least one reel, the at least one reel changing from a first shape to a second shape in response to the graphical interaction between the graphical object and the at least one reel, determine the second shape in real time for the at least one reel according to a physics simulation, the physics simulation programmatically associating the at least one reel and the graphical object with non-rendered rigid body objects and conducting a simulated interaction between the rigid body objects to determine how the at least one reel changes in the graphical interaction in accordance with material properties of the rigid body objects, and receive, via at least one of the one or more electronic input devices, a cashout input that initiates a payout from the credit balance.

2. The gaming system of claim 1, wherein the first shape is defined by a first spline and the second shape is defined by a second spline, the first spline being defined by one or more curves passing through a first set of control points, the second spline being defined by one or more curves passing through a second set of control points, and the one or more controllers are configured to determine the second set of control points according to the physics simulation.

3. The gaming system of claim 2, wherein the physics simulation programmatically associates the first set of control points and the graphical object with the rigid body objects and conducts a simulated interaction between the rigid body objects to determine how the at least one reel changes in the graphical interaction.

4. The gaming system of claim 1, wherein the screen presents the graphical object moving from a first position to a second position, the graphical object interacting with the at least one reel by moving to the second position.

5. The gaming system of claim 1, wherein the screen presents the at least one reel and the graphical object in a rendered three-dimensional environment, and the physics simulation conducts a simulated three-dimensional interaction between the rigid body objects.

6. The gaming system of claim 5, wherein the at least one reel is disposed in a foreground of the three-dimensional environment, and the screen presents the graphical object moving from a first position in a background of the three-dimensional environment to a second position in the foreground, the graphical object interacting with the at least one reel by moving to the second position.

7. The gaming system of claim 1, wherein the graphical object is selected by a player of the wagering game to trigger the interaction between the graphical object and the at least one reel.

8. The gaming system of claim 7, wherein the graphical object is selected by a player from a plurality of selectable graphical objects in a picking game.

9. The gaming system of claim 1, wherein the one or more controllers are configured to randomly trigger the interaction between the graphical object and the at least one reel.

10. The gaming system of claim 1, wherein the physics simulation determines how the rigid body objects would behave in a three-dimensional world according to physical laws.

11. The gaming system of claim 1, wherein each of the rigid body objects occupies its own space and has geometric properties within a three-dimensional environment of the screen.

12. A gaming system comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, direct the electronic display device to display a screen presenting at least one reel and a graphical object, the at least one reel having a first shape defined by a first spline, the first spline being defined by one or more curves passing through a first set of control points, the screen presenting an interaction between the graphical object and the at least one reel, determine in real time, in response to the interaction between the graphical object and the at least one reel, a second shape for the image by determining a second set of control points for a second spline that defines the second shape, the second shape being according to a physics simulation in which the at least one reel and the graphical object are programmatically associated with non-rendered rigid body objects and which is conducted to determine how the at least one reel changes in the graphical interaction in accordance with material properties of the rigid body objects, direct the electronic display device to present on the screen the at least one reel changing from the first shape to the second shape, and receive, via at least one of the one or more electronic input devices, a cashout input that initiates a payout from the credit balance.

13. The gaming system of claim 12, wherein the electronic display device is directed to present on the screen the graphical object moving from a first position to a second position, the graphical object interacting with the at least one reel by moving to the second position.

14. The gaming system of claim 13, wherein the one or more controllers are configured to determine the second set of control points according to the second position of the graphical object.

15. The gaming system of claim 12, wherein the electronic display device is directed to present on the screen the at least one reel and the graphical object in a rendered three-dimensional environment.

16. The gaming system of claim 15, wherein the at least one reel is disposed in a foreground of the three-dimensional environment, and the electronic display device is directed to present on the screen the graphical object moving from a first position in a background of the three-dimensional environment to a second position in the foreground, the graphical object interacting with the at least one reel by moving to the second position.

17. The gaming system of claim 12, wherein the graphical object is selected by a player of the wagering game to trigger the interaction between the graphical object and the at least one reel.

18. The gaming system of claim 17, wherein the graphical object is selected by a player from a plurality of selectable graphical objects in a picking game.

19. The gaming system of claim 12, wherein the one or more controllers are configured to randomly trigger the interaction between the graphical object and the at least one reel.

20. A gaming system comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate the casino wagering game in response to an input indicative of a wager covered by the credit balance, direct the electronic display device to display a screen presenting a first image, the first image following a first spline, the first spline being defined by one or more curves passing through a first set of control points, determine a second set of control points to define a second spline for the first image, direct the electronic display device to present on the screen the first image transitioning from following the first spline to following the second spline, receive, via at least one of the one or more electronic input devices, a cashout input that initiates a payout from the credit balance, wherein the electronic display device is directed to present on the screen a graphical interaction involving the first image, and the one or more controllers are configured to determine the second set of control points in response to the graphical interaction involving the first image, wherein the one or more controllers are configured to determine the second set of control points in real time according to a physics simulation, the physics simulation programmatically associating the first image with non-rendered rigid body objects and conducting a simulated interaction with the rigid body objects based on the graphical interaction, and wherein the physics simulation programmatically associates the first set of control points with the rigid body objects and conducts the simulated interaction to determine how the rigid body objects change based on the graphical interaction and in accordance with material properties of the rigid body objects, the second set of control points being determined by the change in the rigid body objects.

21. The gaming system of claim 20, wherein the graphical interaction on the screen occurs between the first image and a second image.

22. The gaming system of claim 20, further comprising a player input device configured to receive an input from a player, the input causing the graphical interaction with the first image.

* * * * *